United States Patent [19]

Förschner

[11] Patent Number: 4,473,312

[45] Date of Patent: Sep. 25, 1984

[54] FASTENING MECHANISM FOR REMOVABLY FASTENING TOGETHER TWO WORKPIECES

[75] Inventor: Emil Förschner, Augsburg, Fed. Rep. of Germany

[73] Assignee: NCR Corporation, Dayton, Ohio

[21] Appl. No.: 451,214

[22] PCT Filed: Sep. 8, 1982

[86] PCT No.: PCT/US82/01206

§ 371 Date: Dec. 6, 1982

§ 102(e) Date: Dec. 6, 1982

[87] PCT Pub. No.: WO84/00926

PCT Pub. Date: Mar. 15, 1984

[51] Int. Cl.[3] ..... B41J 1/00

[52] U.S. Cl. ..... 400/175; 292/257

[58] Field of Search ..... 400/124, 174, 175; 24/211 R, 241 P, 241 PP, 242, 248 B, 252 R; 292/257, 256, 256.6, 240, 241, 242

[56] References Cited

U.S. PATENT DOCUMENTS

| | | | |
|---|---|---|---|
| 526,233 | 9/1894 | Kauffman | 292/241 |
| 557,408 | 3/1896 | Loetscher | 292/241 |
| 677,622 | 7/1901 | Barney | 292/240 |
| 981,262 | 1/1911 | Heim | 292/240 |
| 1,065,498 | 6/1913 | Beck | 24/211 L |
| 1,718,650 | 6/1929 | Janoir | 292/241 |
| 2,913,543 | 11/1959 | Norris et al. | 200/19 R |
| 3,123,389 | 3/1964 | Biesecker | 292/241 |
| 3,750,792 | 8/1973 | Liles | 400/124 |
| 4,381,896 | 5/1983 | Shiurila | 400/124 |

*Primary Examiner*—Edgar S. Burr
*Assistant Examiner*—M. J. Hirabayashi
*Attorney, Agent, or Firm*—Stephen F. Jewett; Robert L. Clark

[57] ABSTRACT

The invention relates to a fastening mechanism (10) for removably securing together two workpieces, such as the mounting plate (50) of a print head housing (16) and the support blocks 12 of a carriage (10) in a line printer. The fastening mechanism has a locking member (22) having a stud portion (24) mounted on the carriage (10) for rotational and axial movement relative thereto and having abutment surfaces (28) cooperating with cam surfaces (56, 62) on the print head housing (16) upon rotation of the locking member (22) so as to latch together the print head housing (16) and carriage (10) by the action of a spring (38) biasing the locking member in an axial direction. The fastening mechanism enables a simple and rapid removal and mounting of the print head housing (16) to the carriage (10) without the use of any tools.

1 Claim, 5 Drawing Figures

FASTENING MECHANISM FOR REMOVABLY FASTENING TOGETHER TWO WORKPIECES

BACKGROUND OF THE INVENTION

The present invention relates to a fastening mechanism for removably fastening together two workpieces. The invention has particular application to a fastening mechanism for releasably securing a print head to a reciprocating carriage in a printer.

Dot matrix printers are becoming increasingly more important and useful in the field of high-speed document printing. Printers of this kind are extremely advantageous for use with data processing systems wherein it is required to provide a printout of the data generated at very high speeds.

In a wide variety of high-speed printers, a print head carriage carrying the dot matrix print head is slidably mounted on a support shaft and is movable in a bi-directional linear path back and forth along a printing line, the printing being performed by selectively operating a plurality of print wires or ink jets to produce a matrix of dots on a record medium to form alphanumeric characters thereon.

In a known matrix printer arrangement, as disclosed for example in U.S. Pat. No. 3,750,792, the print head unit is secured to the base of the carriage by a number of screws. However, this manner of securing the print head to the carriage has the disadvantage of rendering the removal of the print head for replacement or maintenance work time-consuming and rather difficult because of poor accessability and crowded space conditions around the matrix print head. For example, the screws may inadvertently be dropped into the printer housing while they are being removed or inserted, and they then must be found and retrieved from possibly even more inaccessible places in the printer. Also, the need to use a screwdriver to remove or tighten the screws may give rise to the risk of damaging intricate mechanical or electronic parts or components of the printer if the screwdriver is incorrectly or carelessly used.

SUMMARY OF THE INVENTION

There is provided, according to the present invention, a fastening mechanism for removably securing together first and second workpieces, including a stud member which is mounted on the first workpiece for rotational and axial movement relative thereto and which is arranged to pass through an aperture in the second workpiece, spring means associated with the stud member, and first and second cooperating means respectively provided on the stud member and the second workpiece whereby, with the stud member passing through the aperture and upon rotating the stud member from a first position to a second position, axial movement of the stud member is brought about against the action of the spring means and the first and second workpieces are latched together.

In the described embodiment, the fastening mechanism removably secures the housing of a wire matrix print head to a printer carriage. A support block on the carriage (first workpiece) carries a locking member that includes a stud member and abutment surfaces on the stud member. A mounting plate on the print head housing (second workpiece) is secured to the carriage by rotating the stud member so that its abutment surfaces engage corresponding cam surfaces and indentations on the print head housing.

It is, therefore, an object of the present invention to provide an improved fastening mechanism.

It is another object of the present invention to provide a fastening mechanism for removably fastening together two workpieces which enables the workpieces to be separated and connected together in a simple and rapid manner without the use of any tools.

It is a further object of the present invention to provide a fastening mechanism to permit a print head housing to be readily fastened to and removed from a printer carriage.

These and other objects will become more apparent from the following description when taken in conjunction with the attached drawings.

DETAILED DESCRIPTION OF THE PREFERRED EMBODIMENT

Figure 1:
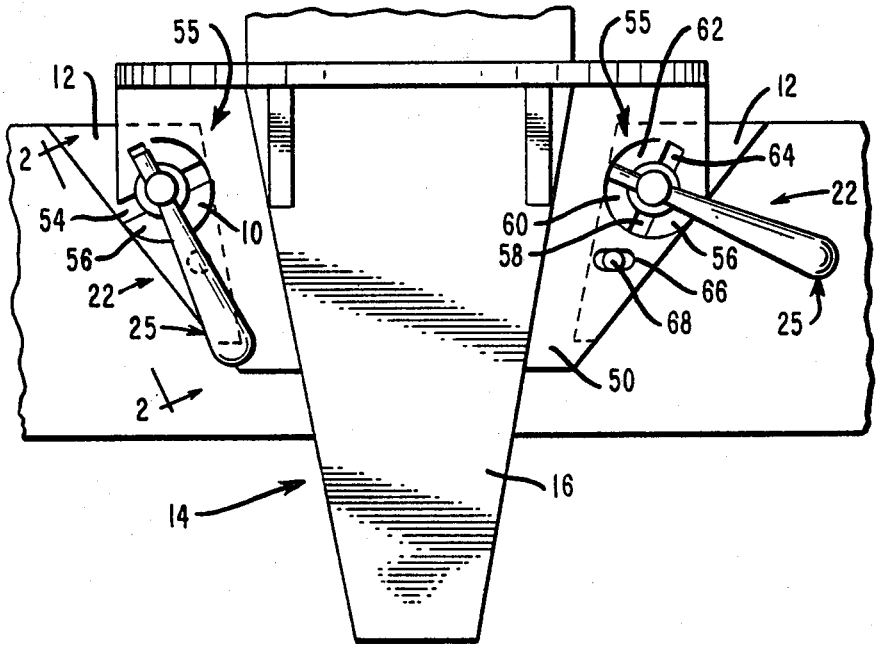
FIG. 1 is a fragmentary top view of a matrix print head housing secured to a carriage of a printer by a fastening mechanism according to the invention.
Figure 2:
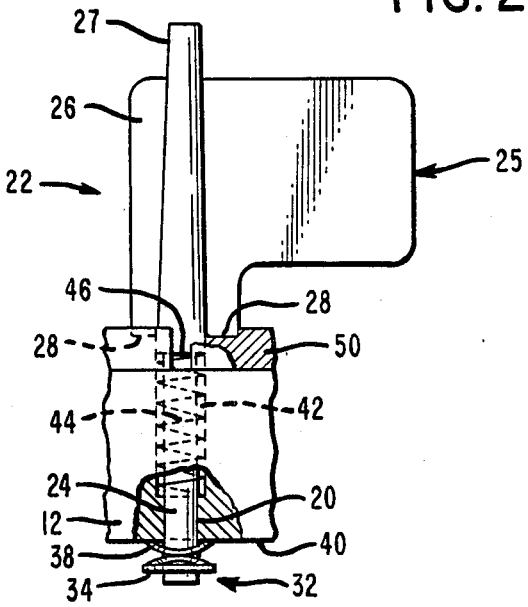
FIG. 2 is a fragmentary elevational view, partly in section, showing in greater detail the locking member of the fastening mechanism according to the invention mounted on support blocks of the carriage of the printer.

Referring to FIGS. 1 and 2, a carriage 10 of a matrix printer is slidably mounted on a support shaft (not shown) for bi-directional linear movement parallel to the line of printing. The carriage 10 is of cast aluminum and is provided with a pair of generally triangular-shaped support blocks 12 on which are mounted a wire matrix print head 14 having a housing 16 for the print wires (not shown) of the head 14. Each of the blocks 12 has a bore 20 therethrough (FIG. 2) having mounted therein a captive locking member 22.

Referring particularly to FIG. 2, each locking member 22 incorporates a steel stud 24 to one end of which is secured a radially extending wing member 25 which is made of a suitable synthetic material, such as DELRIN, and which is bonded to the stud 24 by conventional molding techniques. The wing member 25 has a ridge 26 and a cylindrical portion 27 coaxial with the stud 24. The wing member 25 also has a pair of abutment surfaces 28 thereon which are arranged to engage with a cooperating retaining structure 55 on a print head mounting plate 50, as explained hereafter.

FIG. 2 shows the mounting of a locking member 22 in the respective support block 12 of the carriage 10. The stud 24 of the locking member 22 passes through the bore 20 of the support block 12 and is held captive therein by an end assembly shown generally at 32. The end assembly 32 comprises a split washer 34 held in a circumferential groove (not seen) in the end of the stud 24. A pair of annular spring members 38 bowed in opposite directions are positioned between the washer 34 and an abutting surface 40 of the support block 12. The spring members 38 provide a strong spring or biasing force to urge the locking member 22 downwardly (as viewed in FIG. 2) so as to firmly hold the abutment surfaces 28 into engagement with the retaining structure 55 of the print head housing 16, when the print head housing 16 and carriage 10 are secured together.

The bore 20 has an increased diameter portion 42 for accommodating a compression spring 44 which is mounted around the stud 24 and which serves to weakly bias an annular abutment surface 46 of the locking member 22 away from the support block 12, prior to fastening of the carriage and print head housing. It should be noted that spring 44 plays no part in the actual fastening of print head housing 16 to the carriage 10, it serving its function only prior to fastening. The operation of the spring 44 will be explained in more detail later. In FIGS. 1 and 2, the mounting plate 50 is shown secured to the support block 12 by means of the cooperating abutment surfaces on locking member 22 and retaining structure 55 on plate 50.

Figure 3:
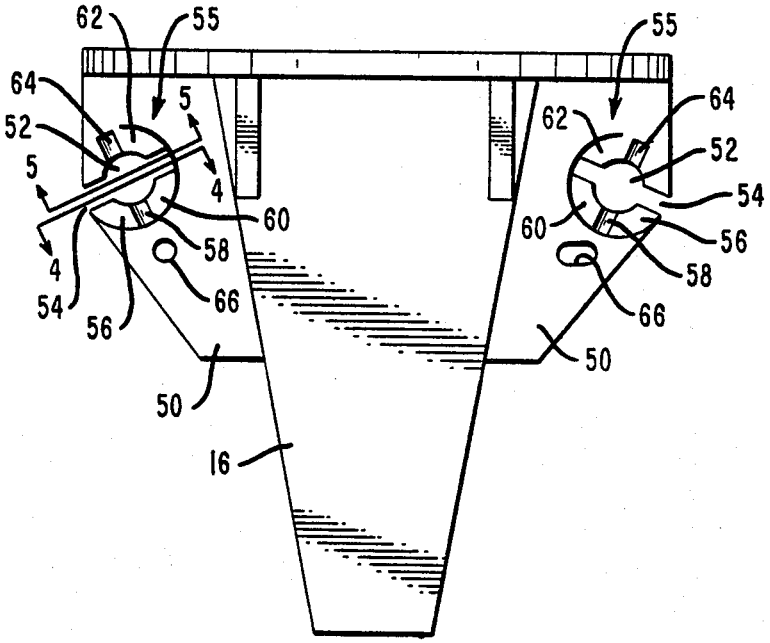
FIG. 3 is a top view of a wire matrix print head housing and mounting plate carrying a retaining structure according to the invention.

FIG. 3 shows the print head housing 16 of FIG. 1 with the carriage 10 and locking members 22 removed, thereby more clearly showing the two mounting plates 50 formed integrally on either side of the housing 16. Each mounting plate 50 has an aperture 52 having a slit 54 extending diametrically therethrough with an open end at the edge of the mounting plate 50. The apertures 52 each have a diameter large enough to permit the cylindrical portion 27 of the relevant locking member 22 to pass therethrough, and the width of each slit 54 is chosen to allow passage of the relevant wing member 25.

Each aperture 52 has the annular retaining structure 55 around its circumference which forms, with locking member 22, the fastening mechanism of the present invention. The retaining structure 55 consists of cam surfaces 56 and 62 for cooperating with the abutment surfaces 28 of the respective locking member 22, and indentations 58 and 64 for receiving the abutment surfaces and retaining the locking members 22 in a latched position.

Figure 4:
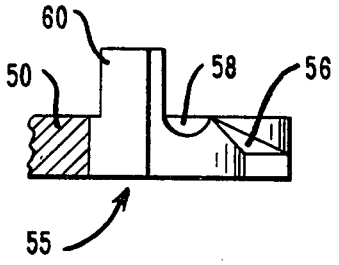
FIG. 4 is a cross-sectional elevation taken along the line 4—4 of FIG. 3.
Figure 5:
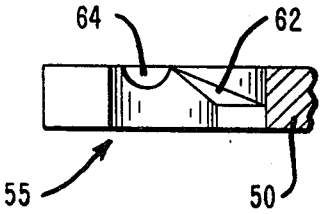
FIG. 5 is a cross-sectional elevation taken along the line 5—5 of FIG. 3.

FIGS. 4 and 5 are cross-sections of the retaining structure 55 taken along a line passing through the middle of the slit 54 and viewed from opposite directions. FIG. 4 shows a rising cam surface 56 followed by an indentation 58 and a stop member 60. On the opposite side of the slit 54, as shown in FIG. 5, the rising cam surface 62 is followed by an indentation 64. As may be seen in FIG. 4, the indentations 58 and 64 of each plate 50 are positioned opposite each other on either side of the associated slit 54, as are the associated cam surfaces 56 and 62.

Two alignment holes 66 (FIGS. 1 and 3) are respectively provided in the mounting plates 50 of the print head. The holes 66 are arranged to engage corresponding rigid mounting pins 68 on the support blocks 12 of the carriage (FIG. 1) to provide automatic and easy alignment of the print head 14 when being mounted onto the carriage 10, and also mechanical support for the print head 14 during operation.

The operation of the fastening means according to the invention is as follows. When it is desired to mount the print head 14 onto the carriage 10 of the printer, the operator positions the wing member 25 of each locking member 22 to point in a direction corresponding to the direction of the respective slit 54. The operator then slips the mounting plates 50 over the locking members 22 so that the wing members 25 thereof pass through the respective slit 54 in the mounting plates 50 and so that the mounting pins 68 enter the alignment holes 66, the increased diameter position 27 of each wing member 25 passing through the respective aperture 52. When the mounting plates 50 abut the facing surfaces of the support blocks 12 of the carriage 10, the operator rotates the locking members 22 by means of the wing members 25 in opposite directions through 90 degrees towards the housing 16.

Thus, with reference to FIG. 1, the left hand wing member 25 is rotated in an anticlockwise direction to the position shown in FIG. 1, and the right hand wing member 25 is rotated in a clockwise direction from the position shown in FIG. 1 to a position in which it is aligned with the associated indentations 58, 64. When the locking members 22 are so turned, the two abutment surfaces 28 on each wing member 25 ride up on the oppositely facing cam surfaces 56 and 62 of the associated mounting plate 50, forcing each locking member 22 to move axially against the force of the associated spring member 38. Each locking member 22 is rotated until the wing member 25 engages the stop member 60 of the associated mounting plate 50, at which point the abutment surfaces 28 are urged into the associated indentations 58 and 64, under the action of the spring members 38, thereby firmly latching the locking member 22 in a closed position in which it secures together the associated block 12 and mounting plate 50.

It should be understood that with each mounting plate 50 abutting against the associated block 12, but, prior to the relevant locking member 22 being rotated to secure the plate 50 and block 12 together, the spring 44 urges the wing member 25 away from the adjacent surface of the block 12 so that the abutment surfaces 28 are spaced slightly away from the adjacent surface of block 12. This slight spacing facilitates the turning of the locking member 22, since the abutment surfaces 28 are positioned to more readily engage the associated cam surfaces 56 and 62.

When it is desired to remove the print head for servicing or repair, the operator unlocks each locking device 22 by first pulling the wing member 25 away from the associated block 12 against the action of the spring members 38 so as to disengage the abutment surfaces 28 from the respective indentations 58 and 64, and then rotates the locking member 22 by means of the wing member 25 away from the housing 16 until the wing member 25 is in alignment with the respective slit 54 in the associated mounting plate 50. The print head 14 can then be lifted off the carriage 10.

Although the presently preferred embodiment of the present invention has been described, it should be understood that within the purview of the present invention various changes may be made within the scope of the appended claims.

I claim:

1. In a printer:

a print head, including a print head housing;

a carriage for movably supporting said print head housing; and a fastening mechanism for removably securing said print head housing to said carriage, said print head housing having an aperture therethrough, said fastening mechanism comprising: a stud member, which is mounted on said carriage for rotational and axial movement relative to said carriage and which is arranged to pass through said aperture in said print head housing; a first spring means associated with said stud member; said print head housing having first and second cam surfaces each extending partially around said aperture and being disposed on opposite sides thereof; said stud member having first and second abutment surfaces extending radially from the longitudinal axis of said stud member at 180 degrees from one another; and said print head housing further having first and second indentations which are respectively adjacent said first and second cam surfaces and are shaped to respectively receive said first and second abutment surfaces of said stud member, so that upon rotating said stud member form a first position to a second position each abutment surface rides up a corresponding one of said first and second cam surfaces against the action of said first spring means and is urged into engagement with a corresponding one of said first and second indentations by said first spring means so as to latch said print head housing and said carriage together; said first spring means providing a strong spring or biasing force to urge the stud member downwardly so as to firmly hold said first and second abutment surfaces of said stud member into respective engagement with said first and second indentations of said print head housing to latch said print head housing and said carriage together in said second position of said stud member; said fastening mechanism further comprising a second spring means arranged to bias said first and second abutment surfaces away from the adjacent cam surfaces of said print head housing prior to rotation of said stud member from said first position to said second position, so that said first and second abutment surfaces are spaced away from said adjacent cam surfaces to facilitate turning of said stud member.

* * * * *